US005486909A

United States Patent [19]

Takenaka et al.

[11] Patent Number: 5,486,909

[45] Date of Patent: Jan. 23, 1996

[54] DEVELOPING DEVICE FOR AN IMAGE FORMING APPARATUS

[75] Inventors: Eiji Takenaka, Isehara; Kazuhiro Yuasa, Zama; Shuichi Endoh, Isehara; Iwao Matsumae, Tokyo; Yoshiaki Tanaka, Kawasaki; Hiroshi Hosokawa, Yokohama; Mugijiroh Uno, Isehara; Hiroshi Saitoh, Ayase; Toshihiro Sugiyama, Atsugi; Tetsuo Yamanaka, Tokyo; Eisaku Murakami, Hiratsuka; Satoru Komatsubara, Atsugi, all of Japan

[73] Assignee: Ricoh Company, Ltd., Tokyo, Japan

[21] Appl. No.: 439,123

[22] Filed: May 11, 1995

[30] Foreign Application Priority Data

May 13, 1994 [JP] Japan ..... 6-099991
Mar. 23, 1995 [JP] Japan ..... 7-064374

[51] Int. Cl.[6] ..... G03G 15/08

[52] U.S. Cl. ..... 355/259; 118/653

[58] Field of Search ..... 355/251, 253, 355/259; 118/653, 657, 658; 430/101

[56] References Cited

U.S. PATENT DOCUMENTS 4,385,829 5/1983 Nakahata et al. ..... 355/253
4,508,052 4/1985 Kohyama ..... 118/651
5,412,456 5/1995 Tanuma et al. ..... 355/259 X
5,438,395 8/1995 Koga et al. ..... 355/253

FOREIGN PATENT DOCUMENTS 62-143075 6/1987 Japan .
3-200991 9/1991 Japan ..... 355/253
5-313475 11/1993 Japan .
5-307323 11/1993 Japan .

*Primary Examiner*—Joan H. Pendegrass
*Assistant Examiner*—Sophia S. Chen
*Attorney, Agent, or Firm*—Oblon, Spivak, McClelland, Maier & Neustadt

[57] ABSTRACT

A developing device for an image forming apparatus and having a relatively hard first developing roller formed with fine N-S magnetic poles on the periphery thereof, and a relatively soft second developing roller for conveying toner electrostatically transferred thereto from the first roller toward a photoconductive drum. The toner is charged by friction while being passed through between the first roller and a blade, and then magnetically deposited on the first roller. At a position where the first and second rollers contact each other, the adequately charged toner is substantially evenly charged by friction and electrostatically transferred from the first roller to the second roller. The second roller conveys the toner toward the drum. The second roller has a surface roughness whose ratio to the mean particle size of the toner is selected to be less than or equal to 1.5.

2 Claims, 6 Drawing Sheets

DEVELOPING DEVICE FOR AN IMAGE FORMING APPARATUS

BACKGROUND OF THE INVENTION

The present invention relates to a developing device for an image forming apparatus and having a relatively hard first developing roller formed with fine N-S magnetic poles on the periphery thereof, and a relatively soft second developing roller for conveying toner electrostatically transferred thereto from the first roller toward a photoconductive drum.

An electrophotographic system is customary with a copier, facsimile apparatus, printer or similar image forming apparatus. This kind of apparatus includes a photoconductive element, or image carrier, and a developing device adjoining the element. A latent image is electrostatically formed on the photoconductive element. The developing device develops the latent image by depositing toner thereon in accordance with the potential distribution of the latent image. For the development, there are available two different systems, i.e., an S-NSP system using a relatively soft developing roller, and a μ-ISP system using a relatively hard developing roller. However, the problem with these conventional systems is that the toner is partly charged to polarity opposite to expected polarity. The oppositely charged toner forms black spots on the background of a recorded image and thereby lowers the image quality.

To obviated the problem attributable to the oppositely charged toner, use may be made of a magnetic first developing roller made of a hard material, and a second developing roller made of a soft material, as proposed in the past. Magnetic toner is magnetically deposited on the first roller, and then electrostatically transferred to the second roller which is so biased as to cause such toner transfer to occur. However, even such an improved scheme is apt to result in an image irregular in density, blurred image or similar defective image.

SUMMARY OF THE INVENTION

It is, therefore, an object of the present invention to provide a developing device for an image forming apparatus and capable of freeing images from irregular density distributions, blurring, background contamination and other defects and thereby ensuring clear-cut images.

A developing device for developing a latent image electrostatically formed on an image carrier by toner of the present invention has a first developing roller made of a relatively hard material and formed with fine N-S magnetic poles on the periphery thereof. The first roller conveys the toner magnetically deposited thereon. A blade contacts the first developing roller and regulates the amount of toner being conveyed by the first developing roller, and charges the toner being passed through between it and the first developing roller by friction. A second developing roller is made of a material softer than the material of the first developing roller and held in contact with the first developing roller. The second roller causes the toner adequately charged to be electrostatically transferred thereto from the first developing roller and conveys it to the image carrier. A bias power source applies a particular bias voltage to each of the first and second developing rollers. The second developing roller has a surface roughness whose ratio to the mean particle size of the toner is selected to be less than or equal to 1.5.

BRIEF DESCRIPTION OF THE DRAWINGS

The above and other objects, features and advantages of the present invention will become more apparent from the following detailed description taken with the accompanying drawings in which.

In the figure, the same or similar constituent parts are designated by the same reference numerals.

DESCRIPTION OF THE PREFERRED EMBODIMENT

Figure 8:
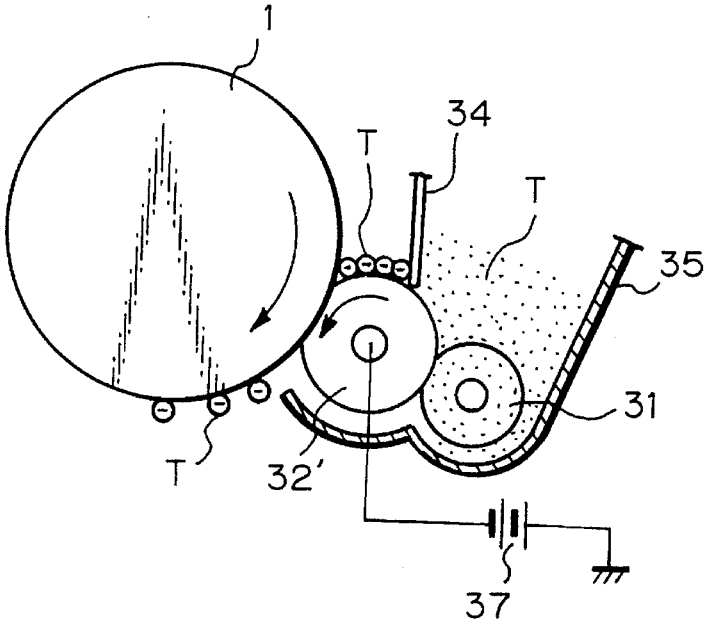
Fig. 8 PRIOR ART
FIG. 8 is a section of a conventional S-NSP type developing device.

To better understand the present invention, a brief reference will be made to a conventional S-NSP type developing device using a developing roller made of an elastic material, shown in FIG. 8. As shown, the device has a developing roller 32' pressed against a photoconductive drum 1 and a toner supply roller 31. In this condition, the roller 32' is elastically deformed to form a nip portion having a predetermined area between it and the drum 1 and between it and the roller 31. The roller 32' is frictionally charged while rotating in contact; with the roller 31. Toner T is stored in a hopper 35. The roller 31 charges the toner T to negative polarity while conveying it from the hopper 35 to the roller 32' . As a result, the toner T is deposited on and conveyed by the roller 32' to which a negative high-tension bias is applied from a high-tension power source 37. A blade 34 regulates the toner T, being conveyed by the roller 32', to a predetermined thickness and thereby forms a thin toner layer on the roller 32'. The roller 32' conveys the thin toner layer to a developing position where it contacts the drum 1. The drum 1 carries an electrostatic latent image thereon. At the developing position, the toner T is transferred from the roller 32' to the drum 1 in an amount matching the potential of the latent image. The drum I conveys the toner T to an image transfer position where an image transfer unit, not shown, is located. As a result, the toner image is transferred from the drum 1 to a paper, not shown.

Figure 9:
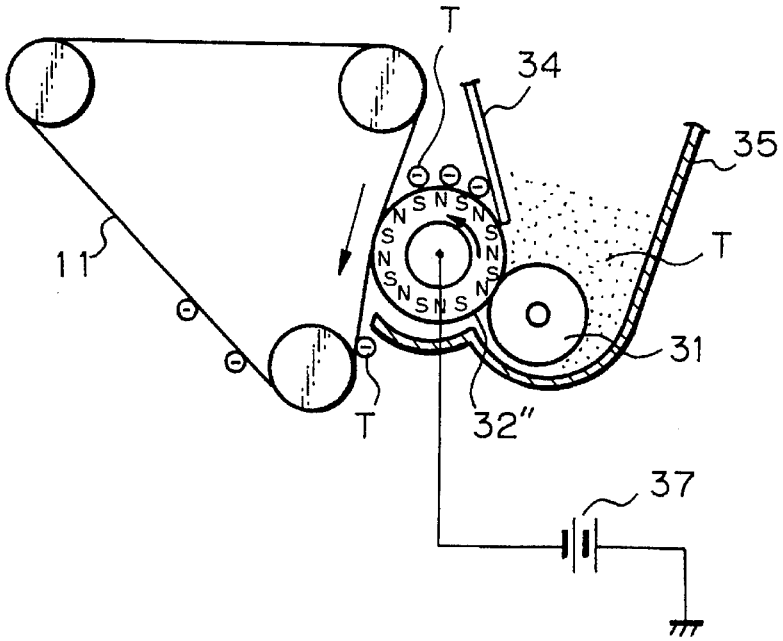
Fig. 9 PRIOR ART
FIG. 9 is a section of a conventional μ-ISP type developing device.

FIG. 9 shows a conventional μ-ISP type developing device using a developing roller made of a hard material. As shown, a developing roller 32" has fine N-S magnetic poles in a surface layer thereof. The toner T stored in the hopper 35 is magnetic toner. The toner T in conveyance is charged by the friction between it and the blade 34 and the friction between particles constituting it themselves. A flexible photoconductive belt, or image carrier, 11 contacts the hard developing roller 32" over a predetermined nip area. The toner T is deposited on the roller 32" and conveyed toward a developing position where the roller 32" contacts the belt 11. At the developing position, the toner T is transferred from the roller 32" to the belt 11 due to the electrostatic force of a latent image carried on the belt 11.

The S-NSP type device shown in FIG. 8 and the μ-ISP type device shown in FIG. 9 each has some problems yet to be solved, as follows. As for the S-NSP type device, the developing roller 32' is made of an elastic material, and therefore apt to suffer from permanent compression set (creep deformation) due to its contact with the blade 34 and drum 1. The deformed roller 32' cannot contact the blade 34 and drum 1 evenly, preventing the thin toner layer to be formed between it and the blade 34. As a result, the expected development of a latent image is obstructed. Moreover, because it is difficult to charge the toner T uniformly, the toner T is often charged to the opposite polarity which causes fine spots or similar smears to appear on the background of an image. The μ-ISP type device is free from the above problems because the developing roller 32" is made of a hard material. However, the soft belt 11, passed over rollers, results in the need for a space for accommodating the belt 11 and a space for accommodating a mechanism for driving it. This makes an image forming apparatus bulky, complicated, and expensive. Further, extra means is needed for preventing the belt 11 from becoming offset in the axial direction of the rollers due to, among others, the uneven tension distribution of the belt 11, in addition, even this type of device cannot avoid the charging of the toner T to the opposite polarity. Specifically, black spots appear on the background of an image, lowering the image quality.

To obviate the problems attributable to the oppositely charged toner, use may be made of a magnetic first developing roller made of a hard material, and a second developing roller made of a soft material, as proposed in the past. Magnetic toner is magnetically deposited on the first roller, and then electrostatically transferred to the second roller which is so biased as to cause such toner transfer to occur. The toner is conveyed by the second roller to a developing position. As a result, the toner charged to the opposite polarity is prevented from arriving at the developing roller.

Generally, in a developing device of the type using only toner, as distinguished from a toner and carrier mixture, the toner is charged by friction when it is passed through between the first developing roller roller, and a blade. To ensure the uniform charging of toner, it is necessary that the amount of toner deposition on the roller for a unit area be limited. Should the roller convey more than the limited amount of toner, the amount of uncharged toner, toner of short charge and oppositely charged toner would increase. The above improved scheme, using the first and second developing rollers, can prevent uncharged toner and oppositely charged toner from arriving at the developing position, but it fails to do so when it comes to toner of short charge. A toner image derived from such toner of short charge fails to have a predetermined density or a predetermined gray level ratio.

Assume that the amount of toner deposition on the first developing roller for a unit area is limited in order to obviate the degradation of an image while ensuring the uniform charging of the toner. Then, the amount of toner for a unit area which can be transferred to a photoconductive element for a unit time is also limited. As a result, it sometimes occurs that an image density as high as that of a document image is not achievable. In the light of this, it has been proposed to rotate the developing roller at a peripheral speed two to three time higher than the peripheral speed of the photoconductive element. This successfully increases the amount of toner for a unit area to be transferred from the developing roller to the photoconductive element.

The improved μ-lSP system charges the toner by friction which occurs when the toner is passed through between the first roller and the blade, as stated earlier. In practice, however, the friction occurs between the drum and the second roller or between the second roller and the first roller due to a difference between their peripheral speeds. Particularly, when the first and second rollers are rotated in the same direction, i.e., when their peripheries are moved in opposite directions relative to each other, the charge deposited on the toner by the resulting friction is not negligible. Although the polarity of the frictional charge depends on, among others, the condition of friction and the materials constituting the two rollers, the charge noticeably changes the amount of charge existing on the toner.

Figure 5A:
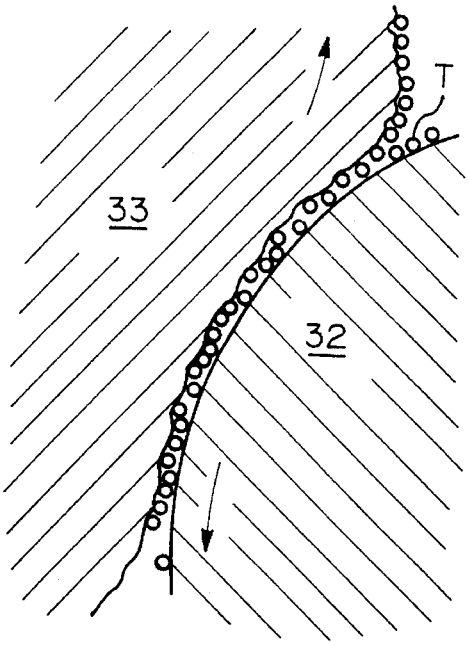
FIGS. 5A and 5B are fragmentary enlarged sections each showing a portion where the second developing roller contacts a first developing roller.

Further, the amount of charge due to the friction between the first and second rollers is apt to become uneven and change over a broader range, depending on the surface condition of the second roller. FIG. 5A shows how the second roller 33 having a rough surface contacts the first roller 32 with the intermediary of the toner T. In FIG. 5A, the directions in which the rollers 32 and 33 move are indicated by arrows. As shown, the toner T magnetically deposited on the roller 32 is charged by friction between the first and second rollers 32 and 33. This, coupled with the electric field extending from the surface of the roller 33 toward the surface of the roller 32, transfers the toner T to the roller 33. At this instant, if the surface roughness of the roller 33 is close to the particle size of the toner T, the toner T in the recessed portions of the roller 33 has little chance to contact the surface of the roller 32 and receives, if contacting it, only a small frictional force. On the other hand, the toner T adjoining the projected portions of the roller 33 frequently contacts the surface of the roller 32 and receives a great frictional force when contacting it. As a result, the toner transferred to the roller 33 is made up of two different parts, one with a noticeably changed charge and the other with a scarcely changed charge.

Figure 6:
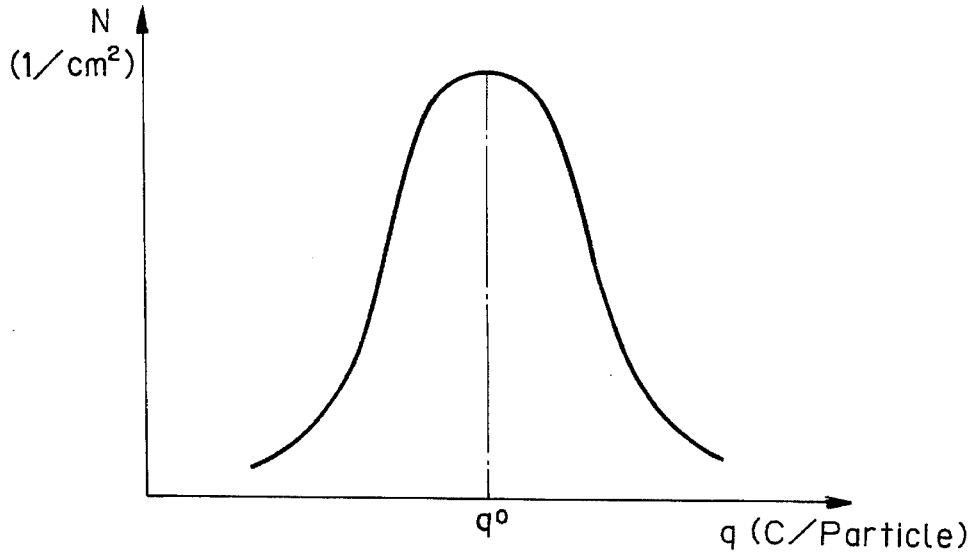
FIG. 6 is a charge distribution curve indicative of the distribution of charges on a single toner particle deposited on the first roller.
Figure 7A:
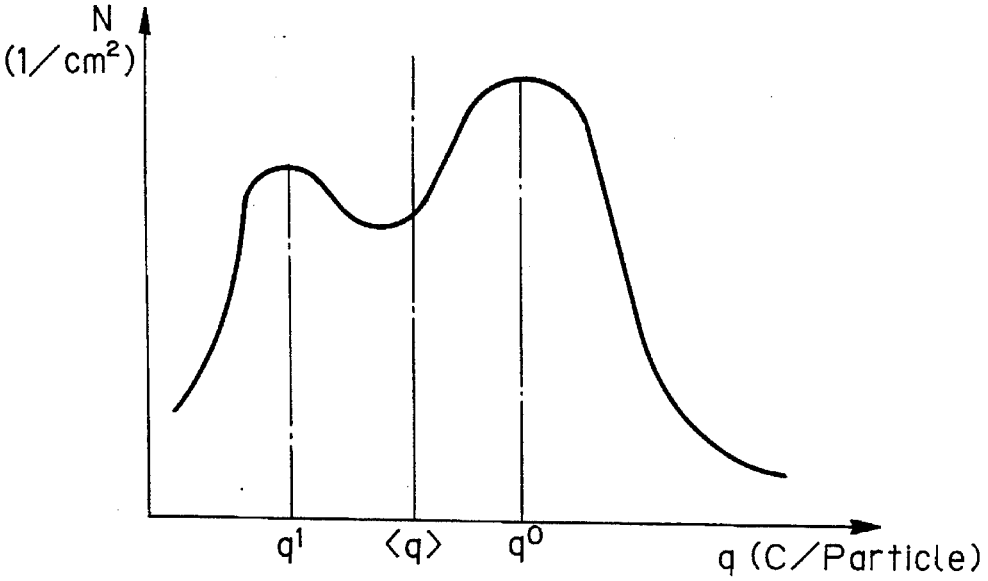
FIGS. 7A and 7B are charge distribution curves each showing the distribution of charges on a single toner particle deposited on the second roller.

FIG. 6 shows a charge distribution on a single toner particle deposited on the first roller 32, while FIG. 7A shows a distribution on the second roller 33 having the above-mentioned surface roughness. As shown in FIG. 6, the charges of the toner particle on the roller 32 have a Boltzmann distribution having a standard charge $q_0$ at the center. However, as shown in FIG. 7A, when the toner particle is transferred from the roller 32 to the roller 33, the charge distribution curve has the maximum value even for a center charge $q_1$ smaller than the standard charge $q_0$ (the toner T is assumed to be positively charged by the roller 32). As a result, the mean charge of the toner T deposited on the roller 33 is noticeably reduced. Moreover, a great number of toner particles of short charge are conveyed to the developing position where the roller 33 contacts the drum 1. The toner particles of short charge are transferred to the drum 1 which has been charged to the negative polarity, but has not been exposed yet. The resulting image is unseemly due to smears on the background.

Conversely, when the toner T is charged to the negative polarity by the first roller 32, the mean charge of the toner T deposited on the second roller 33 noticeably increases. In addition, a great number of toner particles with a great amount of charge are conveyed to the developing position. As a result, such a number of particles cannot be transferred to the exposed portion of the drum 1. The resulting image suffers from an irregular density distribution and blurred edges.

Furthermore, when the toner T in the recessed portions of the roller 33 is brought to the developing position, it cannot receive sufficient electrostatic attraction from the drum 1 and often remains in the recessed portions. Then, the latent image is conveyed to an image transfer position without being developed. This causes white dots to appear in the resulting image or blurs the image.

Figure 2:
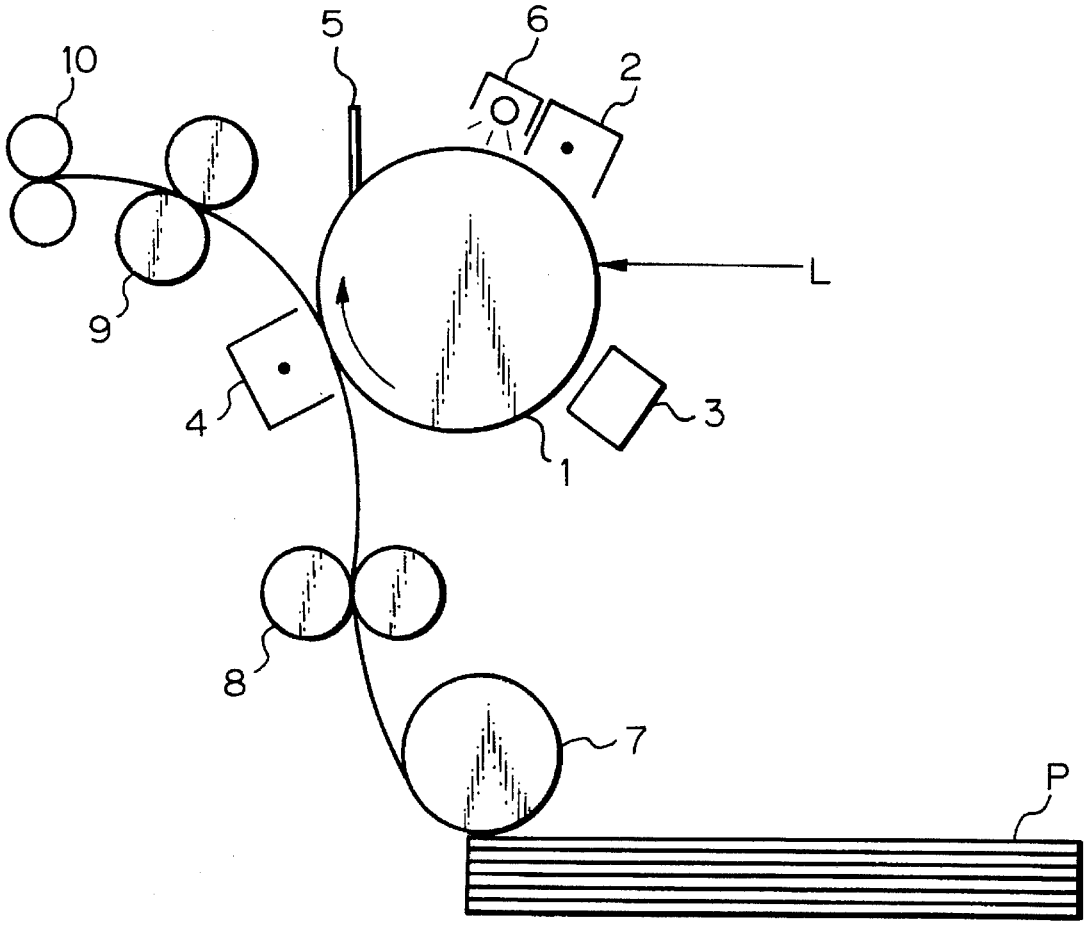
FIG. 2 is a section of a copier having the developing device shown in FIG. 1.

Referring to FIG. 2, an image forming apparatus with a developing device embodying the present invention is shown and implemented as a copier by way of example. As shown, the copier has a photoconductive drum 1 rotatable clockwise, as indicated by an arrow in the figure. While the drum 1 is in rotation, a charger 2 uniformly charges the surface of the drum 1. The charged surface of the drum 1 is exposed imagewise by light L with the result that a latent image is formed thereon in accordance with the intensity of the light L. The latent image is developed by a developing device 3 to turn out a corresponding toner image. The toner image is brought to an image transfer unit 4. A paper P is driven out of a cassette toward a registration roller pair 8 by a pick-up roller 7. The roller pair 8 conveys the paper P toward the image transfer unit 4 in synchronism with the toner image being conveyed by the drum 1. The transfer unit 4 transfers the toner image from the drum 1 to the paper P. The toner image on the paper P is fixed by a fixing unit 9. Finally, the paper P with the fixed toner image is driven out of the copier by a discharge roller pair 10 as a hard copy. After the image transfer, the toner remaining on the drum 1 is removed by a cleaning blade 5. Subsequently, the charge remaining on the drum 1 is dissipated by a discharger 6.

Figure 1:
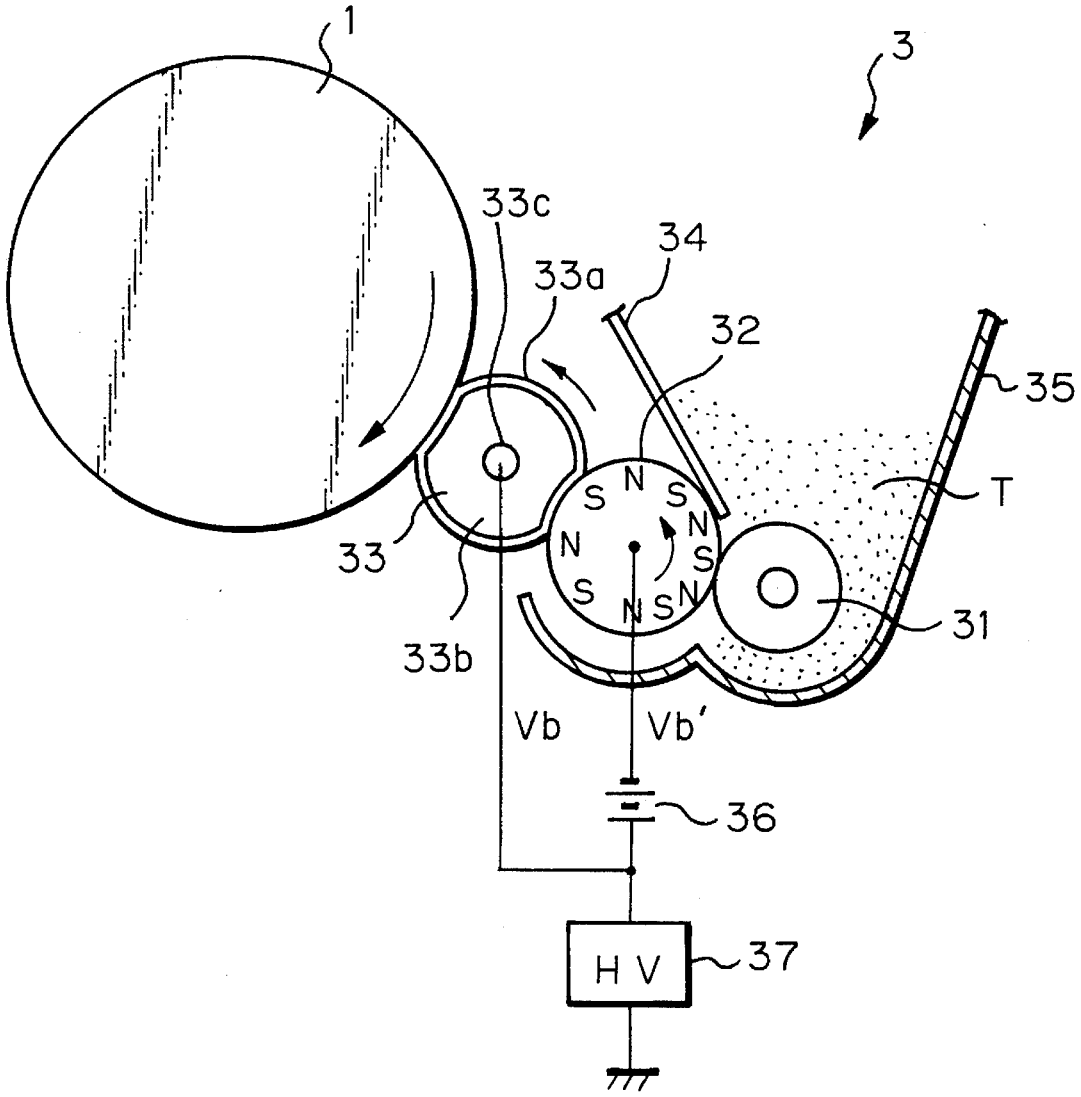
FIG. 1 is a section of a developing device embodying the present invention.

FIG. 1 shows the developing device 3 in detail. As shown, the device 3 has a first developing roller 32 and a second developing roller 33. The second roller 33 is made of an elastic material and made up of two layers. The second roller 33 is held in contact with the drum 1 and moved in the same direction as the drum 1, as seen at the contacting position. The first roller 32 is made of a material harder than the material of the second roller 33 and provided with fine N-S magnetic poles on the surface thereof. The first roller 32 is held in contact with the second roller 33 and moved in the opposite direction to the roller 33, as seen at the contacting position. A toner supply roller 31 is positioned below a hopper 35 storing toner T therein. The supply roller 31 feeds the toner T toward the first roller 32. The toner T is magnetically deposited on the first roller 32 and conveyed toward the drum 1 thereby. A blade 34 regulates the amount of toner T being conveyed by the first roller 32. The second roller 33 is elastically deformed to form a nip portion having a predetermined area between it and the drum 1 and between it and the first roller 32. A negative bias is applied to each of the rollers 31 and 32. A bias power source (HV)37 applies the voltage (bias) Vb of the negative terminal thereof. A bias voltage Vb', consisting of the bias voltage Vb and a negative bias voltage superposed thereon by a DC power source 36, is applied to the roller 32.

Figure 3:
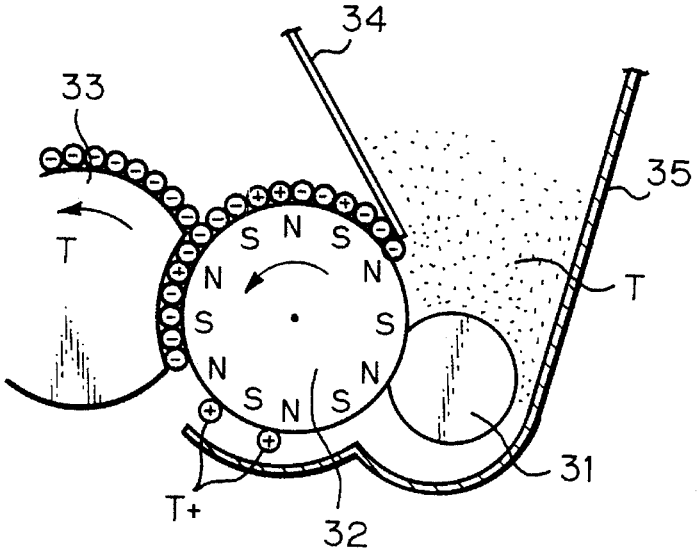
FIG. 3 is a fragmentary enlarged view of the developing device, demonstrating the conveyance of toner.

How the toner T is conveyed in the device 3 is illustrated in FIG. 3. As shown, the toner T, not accompanied by carrier, is driven toward the first roller 32 by the supply roller 31. Then, the toner T is conveyed to the position where the first roller 32 and blade 34 contact each other. The toner T is charged to negative polarity by being rubbed against the blade 34. The charged toner T is brought to the second roller 33 and transferred to the roller 33 by a potential difference between the rollers 32 and 33. The second roller 33 conveys the toner T to a developing position where it contacts the drum 1. Among the toner particles deposited on the roller 32, the particles T+ charged to the opposite polarity, i.e., to positive polarity are not transferred to the roller 33 due to the high negative bias applied to the roller 32. As a result, only the negatively charged toner T is brought to the developing position by the roller 33. The foregoing description has concentrated on negative-to-positive development. In the case of positive-to-positive development, the biases Vb' and Vb applied to the rollers 32 and 33, respectively, will be positive biases and will have a relation of Vb'<Vb.

As shown in FIG. 1, the second roller 33 is made up of a metallic core 33*c*, an elastic layer 33*b* made of resin, sponge, solid rubber or similar material having a volume resistivity of about $10^4$ Ωcm and a thickness of about 5 mm, and an insulative surface layer 33*a* made of fluorine-contained resin, silicone resin or similar material having a volume resistivity of about $10^{12}$ Ωcm and a thickness of about 20 μm. When the roller 33 was pressed against the drum 1 and roller 32, it ate into them in amounts of about 0.2 mm and about 0.4 mm, respectively. The drum 1, roller 33 and roller 32 are held in a ratio of 1:1.1:3 as to the rotation speed.

Figure 4:
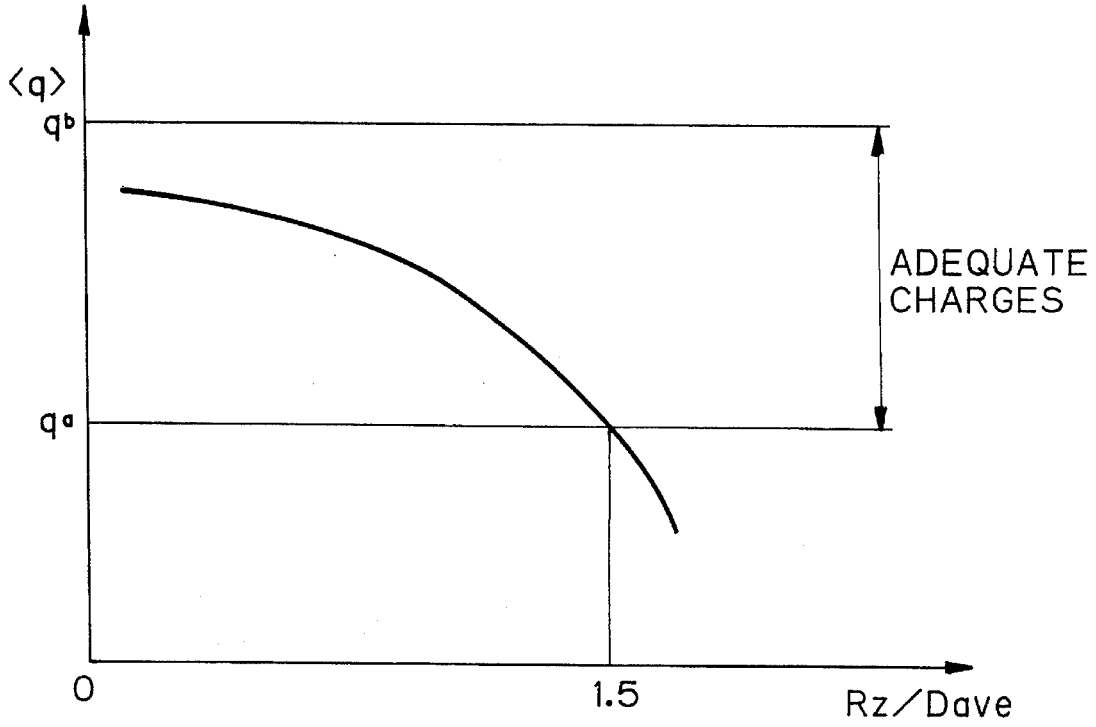
FIG. 4 is a graph showing a relation between the amount of charge deposited on toner and the ratio of the surface potential of a second developing roller to the mean particle size of the toner.

FIG. 4 shows a relation between the mean charge <q> of the toner and the ratio of the surface roughness Rz of the second roller 33 to the mean toner particle size Dave. As shown, the adequate mean charge <q> lies in a range of $q_a \leqq \langle q \rangle \leqq q_b$. It follows that the adequate range of Rz/Dave is Rz/Dave ≦1.5. In the illustrative embodiment, use is made of toner having a mean particle size Dave of 7.5 μm.

Figure 7B:
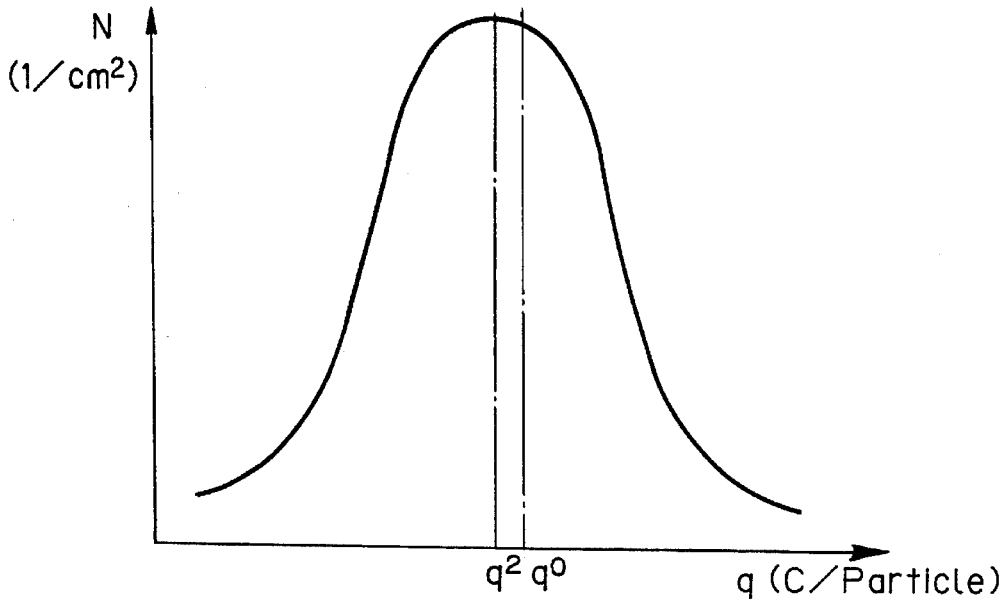

FIG. 7B shows a charge distribution on a single toner particle T deposited on the second roller 33 whose surface roughness Rz lies in the above adequate range. As shown, the charge distribution changes little; the standard charge $q_o$ is shifted to a center charge $q_2$ slightly smaller than $q_o$ due to the friction of the toner T with the first roller 32.

Figure 5B:
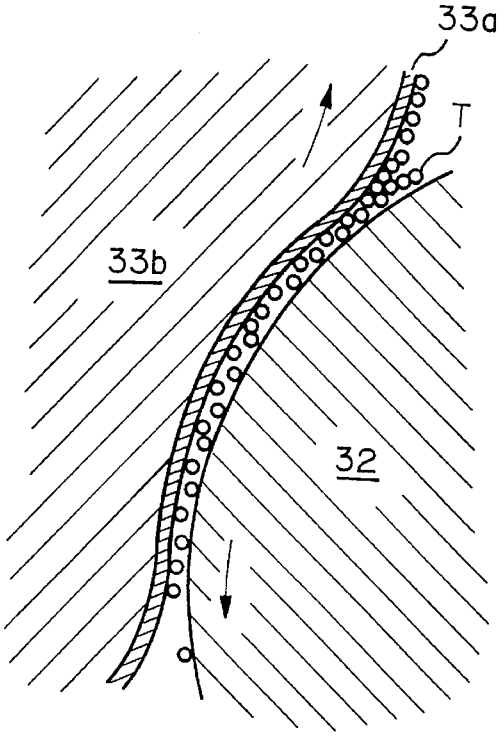

FIG. 5B is an enlarged section showing the rollers 32 and 33 of the embodiment rubbing against each other. As shown, the toner T magnetically deposited on the roller 32 is frictionally charged at the position where the rollers 32 and 33 contact each other. The charged toner T is transferred from the roller 32 to the roller 33 by the electric field extending from the surface of the roller 33 toward the surface of the roller 32. In this condition, substantially the same charge is deposited on all the particles of the toner T being transferred from the roller 32 to the roller 33. Because the charge on each toner particle T only slightly decreases, the charge distribution shown in FIG. 7B is achievable.

In summary, in accordance with the present invention, the ratio of the surface roughness of a second developing roller to the mean particle size of toner is selected to be less than or equal to 1.5. The second roller is made of a relatively soft material. Hence, a recorded image is free from irregular density, blur, background contamination and other defects attributable to, for example, friction between the toner and a first developing roller contacting the second roller, and the toner in the recessed portions of the second roller. Therefore, the device of the present invention ensures clear-cut images.

Various modifications will become possible for those skilled in the art after receiving the teachings of the present disclosure without departing from the scope thereof.

What is claimed is:

1. A developing device for developing a latent image electrostatically formed on an image carrier by toner, comprising:

a first developing roller made of a relatively hard material and formed with fine N-S magnetic poles on a periphery thereof, and for conveying the toner magnetically deposited on said periphery;

a blade contacting said first developing roller, and for regulating an amount of the toner being conveyed by said first developing roller, and for charging said toner being passed through between said blade and said first developing roller by friction;

a second developing roller made of a material softer than the material of said first developing roller and held in contact with said first developing roller, and for causing the toner adequately charged to be electrostatically transferred from said first developing roller to said second developing roller, and for conveying said toner to the image carrier; and a bias power source for applying a particular bias voltage to each of said first and second developing rollers;

wherein said second developing roller has a surface roughness whose ratio to a mean particle size of the toner is less than or equal to 1.5.

2. A developing device as claimed in claim 1, wherein said second developing roller has an insulative surface layer and a semiconductive elastic layer underlying said insulative surface layer.

* * * * *